United States Patent [19]

Dalhuisen

[11] Patent Number: 4,622,004

[45] Date of Patent: Nov. 11, 1986

[54] GAS BURNER SYSTEM

[75] Inventor: Peter B. Dalhuisen, At Ugchelen, Netherlands

[73] Assignee: Veg-Gasinstituut N.V., Apeldorn, Netherlands

[21] Appl. No.: 698,111

[22] Filed: Feb. 4, 1985

[30] Foreign Application Priority Data

Feb. 8, 1984 [NL] Netherlands ..... 8400406

[51] Int. Cl.[4] ..... F23N 5/00

[52] U.S. Cl. ..... 431/76; 236/15 E

[58] Field of Search ..... 431/12, 76, 89, 90; 236/15 E

[56] References Cited

U.S. PATENT DOCUMENTS

| | | | |
|---|---|---|---|
| 4,362,499 | 12/1982 | Nethery | 431/76 |
| 4,406,611 | 9/1983 | Michel | 431/76 |
| 4,441,982 | 4/1984 | Ueno | 431/76 |
| 4,449,918 | 5/1984 | Spahr | 431/76 |
| 4,492,559 | 1/1985 | Pocock | 431/76 |

FOREIGN PATENT DOCUMENTS

| | | | |
|---|---|---|---|
| 161131 | 12/1979 | Japan | 431/76 |
| 187527 | 11/1982 | Japan | 431/76 |

*Primary Examiner*—James C. Yeung

*Attorney, Agent, or Firm*—Mandeville and Schweitzer

[57] ABSTRACT

The burner system includes an apertured burner plate with low thermal conductivity which is adapted to be positioned in a closed combustion chamber. A mixing chamber below the combustion chamber has a gas inlet and an air inlet. A fan is operatively arranged in the mixing chamber. A detector provides an electric detection signal which varies with the composition of the burnt gas in the combustion chamber. The detection signal is applied to the input of an electronic control unit, which in response to the detection signal produces at least one output signal. Control means are responsive to the output signal for controlling the air-gas mix supplied to the mixing chamber.

9 Claims, 3 Drawing Figures

GAS BURNER SYSTEM

BACKGROUND OF THE INVENTION

The invention relates to a gas burner system. A known burner system uses: a burner plate arranged within a closed combustion chamber; on the other side of the burner plate from the combustion chamber is a mixing chamber having a gas inlet and an air inlet; a fan feeds the air-gas mix from the mixing chamber through the apertures of the burner plate into the combustion chamber. Such a system is described in U.K. Pat. No. 2.063.451.

This known burner system is not suited for applications in which it is required to operate with a substantially variable load because (1) the burner is provided with a metal burner plate having a limited load range, and (2) the gas supply must be controlled to avoid large deviations from the air-gas mix ratio preset by the manufacturer. If too much or not enough air is in the air-gas mix, the combustion efficiency will be reduced and/or the concentration of injurious combustion products may increase to a dangerous level.

Furthermore, in this known burner system, aging, corrosion, and clogging of the burner will result in deviations from the originally-set mix ratio, leading to the need for relatively frequent maintenance.

SUMMARY OF THE INVENTION

The novel burner system includes an apertured burner plate with low thermal conductivity adapted to be positioned in a closed combustion chamber, a mixing chamber having a gas inlet and an air inlet, a fan operatively arranged in the mixing chamber, an electronic control unit; and a detector providing an electric detection signal which varies with the composition of the burnt gas in the combustion chamber. The detection signal is applied to the input of the control unit which in response to the detection signal produces at least one output signal. Control means are responsive to the output signal for controlling the air-gas mix supplied to the mixing chamber.

DETAILED DESCRIPTION OF PREFERRED EMBODIMENTS

Figure 1:
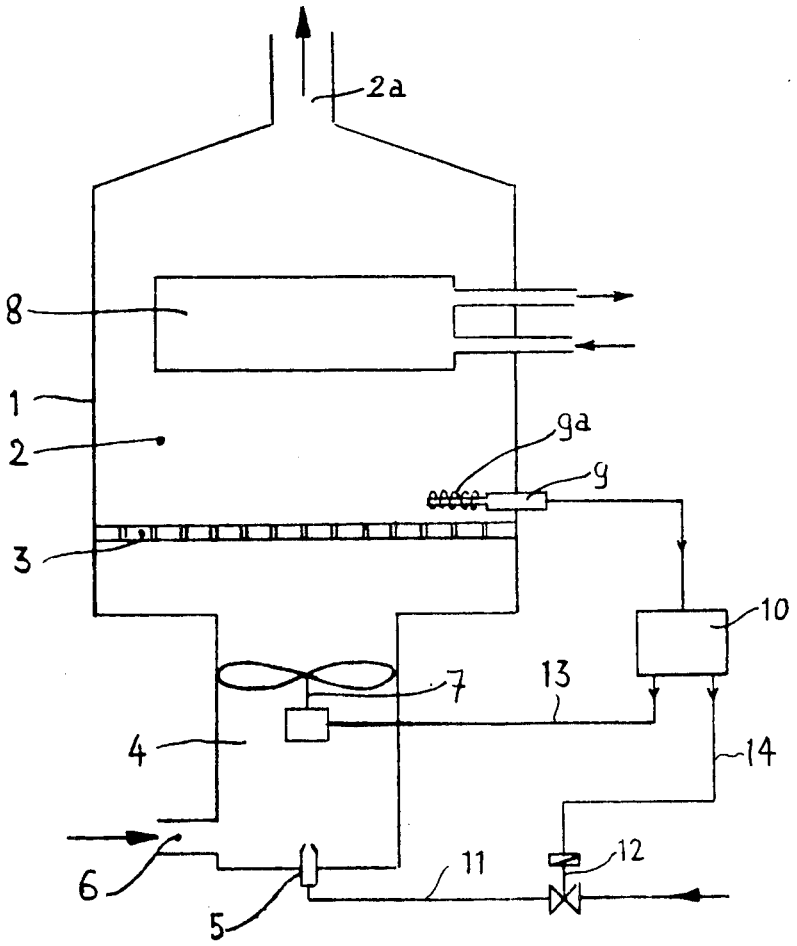
FIG. 1 is a representation of an air or water heating appliance utilizing the gas burner system according to the invention.

This invention provides a gas burner system of the type described in said British patent from which the stated drawbacks have been eliminated. The novel burner system uses a burner plate having a low thermal conductivity. Within the combustion chamber, a redox detector is arranged above the burner plate. The detector has an electrical resistance which varies with the composition of the burnt gas. An electronic control unit receives as its input the detection signal from the detector. The control unit, in turn, produces one or more output signals for controlling the supply of gas and/or air to the mixing chamber.

The burner plate has a low thermal conductivity, which enables the burner system to be operated over a relatively wide load range because the maximally permissible load of such a burner is a multiple of the lowest possible load which will not cause the flame to flashback.

By controlling the air-gas mix ratio in accordance with the concentration of reducing components in the burnt gas, the novel burner system will achieve for each load and gas composition, a mix ratio suitable for complete combustion. Any variation in the mix ratio as a result of wear and/or clogging of the burner will be automatically corrected until the mix ratio reaches a value above the control range of the control unit, which will shut off the gas supply. In addition, the control unit can be used for signaling a wear or clogged condition even when the control range of the unit is not yet exceeded. This warning allows servicing the burner at short notice to avoid exceeding the control range.

The automatic correction of the air-gas mix ratio permits servicing the burner at longer time intervals without decreasing the combustion efficiency and/or increasing the formation of injurious combustion products.

When an appliance uses the novel burner system, it is not necessary to employ a back draft diverter. Also, no particular requirements need be made in the construction of the discharge duct to ensure the safe functioning of the appliance, because any increase in the concentration of reducing gas components in the combustion chamber, resulting from a blockage in the discharge vent, will be detected by the redox detector. The detector will counteract by changing the air-gas mix ratio, and the control unit will issue a danger signal and will shut off the gas supply to the burner if the problem is not quickly remedied.

By disposing the redox detector a short distance above the burner plate, where in operation the temperature does not appreciably vary, the detector can be provided with a heating element which will preheat the detector to its required operating temperature prior to supplying and igniting the air-gas mix to the combustion chamber.

The heating element will also allow the detector to maintain its required operating temperature range, and will prevent the detection signal from changing solely in response to changes in the temperature sensitivity of the detector.

Also, if the air-gas mix does not ignite, the control unit will send a control signal to shut off the gas supply to the mixing chamber.

By preheating the detector to its normal operating temperature before the air-gas mixture is fed to the combustion chamber, the high concentration of reducing gas components, which normally occurs during a short time interval, and is increased immediately after burner ignition, will be detected by the detector. If the air-gas mix does not ignite, this dangerous concentration will be allowed to remain only for a predetermined time, for instance 1–2 seconds, and then the gas supply will be shut off by the control unit. The heating element can also be used for igniting the air-gas mix, which avoids the need for a separate igniter, such as a pilot burner or an electrical igniting device.

Referring more specifically to the drawings, the appliance shown in FIG. 1 comprises an enclosure 1 defining a closed combustion chamber 2 and a channel 2*a* for discharging the burnt gases from the combustion chamber. A heat exchanger 8 is disposed within combustion chamber 2 for heating water or air. The novel burner system comprises a burner plate 3 of refractory material which is positioned within the combustion chamber. Enclosure 1 forms a mixing chamber 4 on the side of the burner plate opposite the combustion chamber. Mixing chamber 4 has a gas inlet 5 and an air inlet 6. A fan 7 is mounted within mixing chamber 4 between inlets 5 and 6, on one hand, and burner plate 3, on the other hand. The air-gas mix introduced into mixing chamber 4 is fanned through the apertures in burner plate 3 into combustion chamber 2, where it is burnt without adding further air, commonly known as secondary air.

A short distance above burner plate 3 is positioned a redox detector, such as carbon monoxide detector 9. The electrical detection signal generated by detector 9 is applied to the input of an electronic control unit 10, which has an output line 13 connected to fan 7 and/or an output line 14 connected to the fuel valve 12 disposed in the fuel supply line 11.

Control unit 10 is constructed so that whenever the carbon monoxide concentration in the burnt gases, as measured by detector 9, exceeds a predetermined limiting value, a control signal will be sent via line 13 to fan 7 and/or via line 14 to gas valve 12. Responding to the control signal or signals from unit 10, the air volume and/or the gas volume supplied to chamber 4 will vary by an amount to bring the carbon monoxide concentration in the burnt gas within predetermined limit values.

If after ignition carbon monoxide concentration in the burnt gases becomes higher than the predetermined limit value, the output from control unit 10 will cause fan 7 to rotate at a higher speed to increase the air content in the air-gas mix. The speed of fan 7 is subsequently decreased until the detection signal reaches a value which lies within the predetermined limit values for carbon monoxide concentration.

According to a further embodiment of the invention, control unit 10 will decrease the excess air fanned by fan 7 in small steps from a high value until the occurrence of a predetermined increase in the level of the detection signal. In response to an increase in the detection signal, the excess air is increased by a predetermined amount and subsequently again decreased in small steps (gradient control).

The excess air is decreased by control unit 10 in small steps of say, 0.01–0.025%, starting from a selected high value of, say, 10–20% at the ignition of the burner, until the relative increase in the detection signal between two points in time reaches a predetermined value of, say, 10–40% of the total signal.

In response to a predetermined increase in the detection signal, the air is increased by a predetermined amount (say 1–2%) and subsequently decreased again in small steps. The value to which the excess air is increased, in response to an increase in the detection signal, may be lower than the excess air value at the ignition of the burner and may amount to, say, 1–7%, and preferably less than 4%.

Carbon monoxide detector 9 and control unit 10 will automatically return the carbon monoxide concentration in the burnt gas to within the predetermined limit values upon the occurrence of each deviation from these values. This automatic adjustment of CO concentration will occur regardless of whether the deviation is due to a variation in the load on the burner, as a result of an increase or decrease in the amount of gas supplied thereto, or is caused by aging, corrosion, or clogging of the burner itself, or blockage of the flue outlet or chimney draft of the appliance.

The appliance using the gas burner system according to the invention can easily control variable loads, is reliable and safe in operation, and requires comparatively little maintenance.

In order to check the safety of a gas appliance equipped with the gas burner system according to the invention, the response of the appliance to deliberately created situations was examined:

A. Dangerous Situations

1. Failure of the air-gas mix to ignite.
2. Closure of the burnt gas discharging duct.
3. Heavy clogging of the heat-exchanger.
4. Increase and decrease in the gas pressure by 30%.
5. Reduction of the air inlet opening.

B. Reactions

The appliance reacted to these respective situations as follows:

1. Closure of the gas valve.
2. Closure of the gas valve.
3. Change of the air-gas ratio and, in case of too-heavy clogging, closure of the gas valve.
4. Readjustment of the air-gas ratio.
5. Readjustment of the air-gas ratio followed by closure of the gas valve when the air inlet opening becomes too small.

Figure 2:
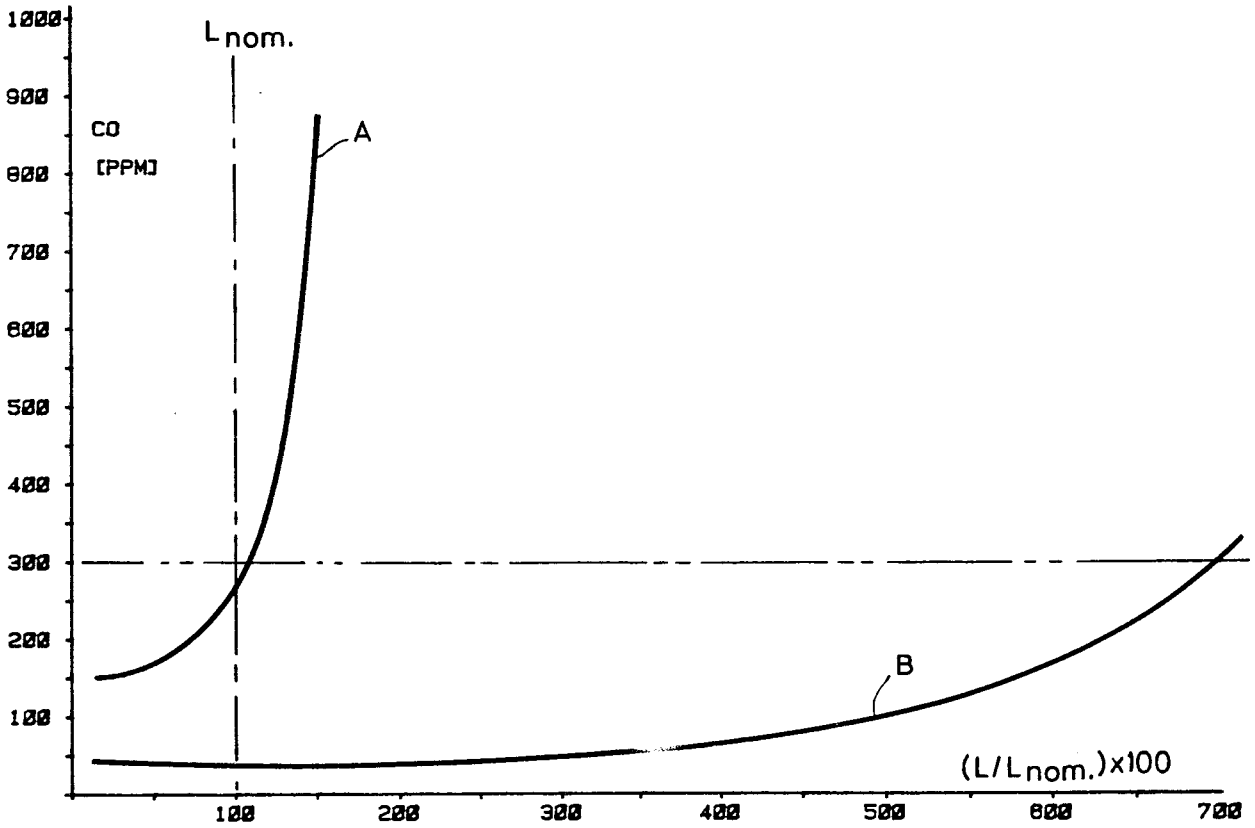
FIG. 2 is a graph of the CO-production during combustion as a function of the relative load for a known gas burner and for a gas burner system according to the invention.

Curve A in FIG. 2 represents the CO-concentration in the burnt gas as a function of the relative loading ratio $L/L_{nom}$ for a conventional known household gas heater. From this curve, it appears that even a slight exceeding of the nominal loading $L/L_{nom}$ ratio causes a very strong increase in the CO-concentration of the burnt gas.

Curve B in FIG. 2 represents the CO-concentration in the burnt gas as a function of the relative loading for the gas heater equipped with a gas burner system according to the invention, using a type "Figaro CMS 202" carbon monoxide detector 9 as the redox detector. Curve B shows that even a very large variation in the loading does not cause an appreciable increase in the CO-concentration.

Figure 3:
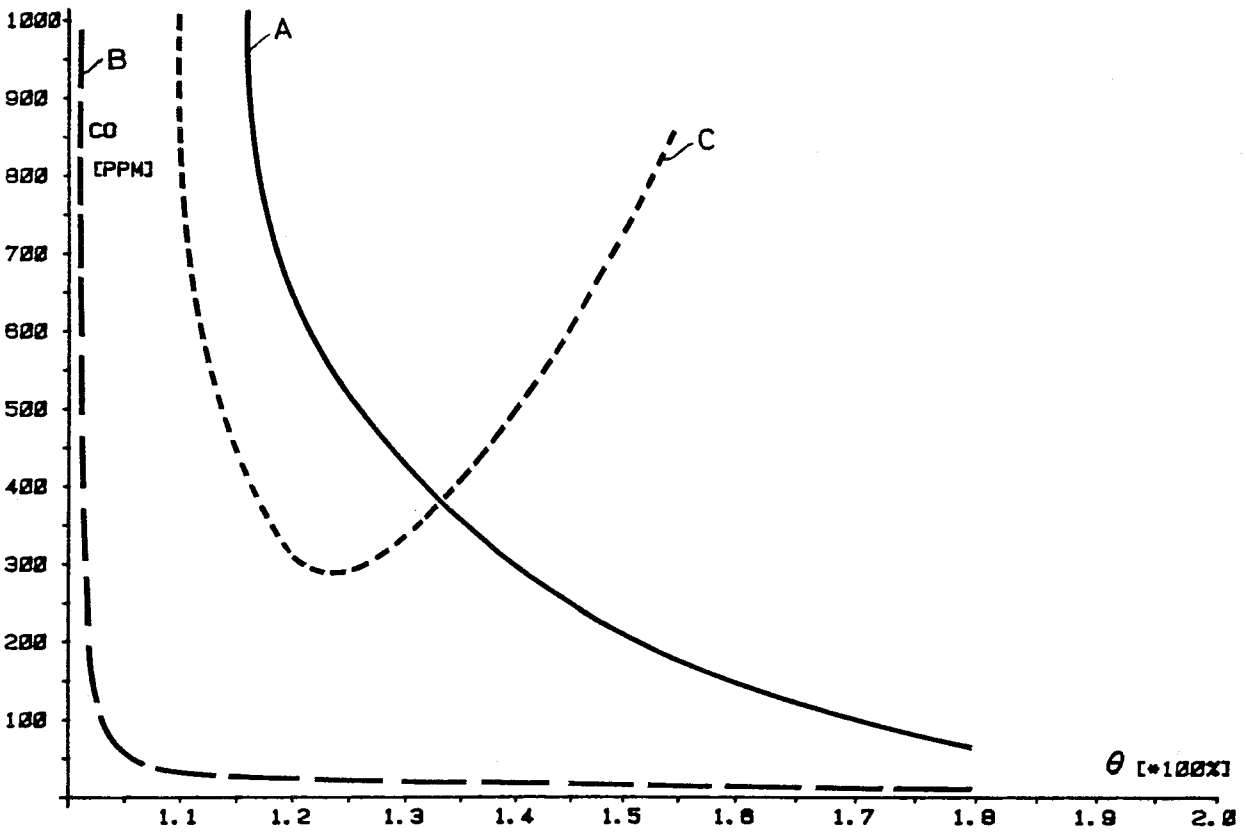
FIG. 3 is a graph of the CO-production as a function of the air factor for two known gas appliances and for a gas appliance including the gas burner system according to the invention.

Curves A, B, and C in FIG. 3 respectively show the CO-concentration as a function of the excess air factor $\theta$ for (A) a conventional domestic gas heater, (B) an appliance with a gas burner system according to the invention, and (C) a high-efficiency central heating boiler. Curves A, B, and C demonstrate that an appliance equipped with a gas burner system according to the invention can be operated with a minimum of excess air in the air-gas mix, which results in a much higher fuel efficiency.

The gas burner system according to the invention is preferably equipped with a ceramic burner plate to provide a stable flame over a wide load range and to have a considerably longer working life than the known metal burner plates, which are sensitive to corrosive attack.

A very uniform distribution of the air-gas mix over the ceramic burner plate surface is obtained., The concentration of the reducing gas components, formed upon combustion of the air-gas mix, will have the same value over the entire surface of the plate. This permits using such a low limiting value for carbon monoxide concentration as the criterion for controlling the mixing ratio that a nearly stoichiometric combustion (air factor $\theta < 1.1$) is maintained which, in view of the detector's characteristics, is preferred for controlling devices.

Especially for measuring very low carbon monoxide concentrations, the carbon monoxide detector 9 should be positioned at a short distance above the surface of the burner plate, since the temperature in the proximity of the burner plate is substantially constant, whereas at greater distances from the plate, the temperature can vary substantially, due to temperature changes which occur in the fluid being circulated through the heat-exchanger.

In the appliance shown in FIG. 1, carbon monoxide detector 9 is provided with a heating element 9*a* in the form of a resistance wire wound around the detector. When putting the burner system into operation, this heating element will heat the detector to its operating temperature prior to releasing the gas supply to the burner. The same resistance wire can also be used to ignite the air-gas mix.

The preheating of the redox detector will cause the detector to detect relatively low concentrations of reducing gas components which occur in the air-gas mix due to excess air therein. It will also detect the increasing temperature of the mix upon ignition. Control unit 10 will shut off the gas supply if the high concentration of reducing gas components remains present for a time exceeding a predetermined time period (say 1–2 seconds) following attempted ignition.

Any suitable known analog control circuit or microprocessor can be used for control unit 10.

The gas burner system according to the invention is not limited to the uses described above. It can, for example, also be used in kitchen or bathroom appliances.

For application as a gas burner for a cooking appliance, the burner itself can be arranged in the above-described manner and mounted within an enclosure which is covered on top by a metal cooking plate provided with a flue discharge vent.

The gas burner according to the invention has the additional advantage of discharging very low concentrations of noxious substances in the flue gas. Whereas the emission level of $NO_x$—compounds in the flue gas of conventional gas burners has a value of 100–150 ppm or even higher, with the gas burner system of the invention this value is less than 40 ppm and can be less than 15 ppm. It was found that when the air factor $\theta = 1.05$, the CO-concentration in the exhaust gas was 30 ppm, while the $NO_x$—concentration was 14 ppm.

Finally, the gas burner system according to the invention, in a special small embodiment (say with 100–500 W power), can be used as a pilot burner for controlling the supply of oxygen to a large industrial burner, say with a power of 100 KW. This pilot burner should be connected in parallel with the industrial burner to the gas supply line. The amplitude of the control voltage supplied to the fan of this pilot burner can constitute a measure of the oxygen requirement for the industrial burner. Consequently, this voltage can be used as a signal for controlling the supply of oxygen to the industrial burner.

Other applications will readily become apparent to those skilled in the burner art.

What is claimed is:

1. A gas burner and control system therefor, which comprises (a) means forming a closed combustion chamber having an inlet side and an outlet side, (b) means forming a mixing chamber on the inlet side of said closed combustion chamber, (c) a ceramic burner plate of low thermal conductivity, having distributed apertures therethrough, located at the inlet side of said closed combustion chamber, (d) valve means for supplying combustion gas to said mixing chamber, (e) controllable air supply means for supplying combustion air to said mixing chamber to be mixed with said combustion gas in controllable ratios of gas to air, (f) a redox detector mounted within said closed combustion chamber for detecting the composition of products of combustion in said closed chamber, (g) said redox detector being of the type which varies in electrical resistance as a function of the composition of the products of combustion, (h) the arrangement of said redox detector and said closed combustion chamber being such as to provide for relatively constant temperature operation of said redox detector with varying loads in said combustion chamber, and (i) control circuit means responsive to changes in resistance of said redox detector to controllably vary the gas and/or air supply to said mixing chamber to maintain efficient combustion therein.

2. A gas burner and control system according to claim 1, further characterized by (a) heating means being provided for said redox detector, in order to maintain said detector at a relatively constant operating temperature.

3. A gas burner and control system according to claim 1, further characterized by (a) said redox detector being mounted a short distance from said ceramic burner plate, and thereby being maintained at a relatively constant operating temperature during normal operation of the gas burner and system under varying loads.

4. A gas burner and control system according to claim 1, further characterized by (a) said redox detector being provided with a heating element for preheating of the detector to a desired operating temperature prior to the initial supply of gas-air mixture to the combustion chamber.

5. A gas burner and control system according to claim 4, further characterized by (a) said preheating element serving additionally to cause ignition of the gas-air mixture during start-up of the gas burner.

6. A gas burner and control system according to claim 1, further characterized by (a) said redox detector comprising a carbon monoxide detector.

7. A gas burner system, which comprises (a) means forming a closed combustion chamber having an inlet side and an outlet side, (b) an apertured burner plate of ceramic material of low thermal conductivity defining the inlet side of said closed combustion chamber, (c) means forming a mixing chamber upstream of said burner plate having a gas inlet and an air inlet, (d) a fan for controllably causing air to be supplied to said mixing chamber, (e) a valve for controllably causing gas to be supplied to said mixing chamber, (f) a passive carbon monoxide detector located in said closed combustion chamber and arranged to provide an electrical resistance value which varies with the concentration of CO in the burnt gas, and (g) an electronic control unit having an input and an output, (h) said carbon monoxide detector, by variation of its resistance, providing a variable detection signal to the input of said control unit, and said control unit, in response thereto, producing at least one output signal for controlling the air-gas mixture in said mixing chamber.

8. A gas burner system according to claim 7, further characterized by (a) a variably loaded heat exchange device located within said closed combustion chamber.

9. A gas burner according to claim 7, further characterized by (a) the electronic control unit being arranged so that the excess air, starting from a high value is decreased in small steps until the occurrence of a predetermined change of the detector resistance, (b) then in response to said change of the detector resistance, the excess air is increased by a predetermined amount and subsequently again is decreased in small steps.

* * * * *